United States Patent [19]

Neal

[11] Patent Number: 4,763,732

[45] Date of Patent: Aug. 16, 1988

[54] CABINET STRUCTURE FOR FIRE EXTINGUISHERS OR THE LIKE

[76] Inventor: Thomas C. Neal, P.O. Box 5563, Incline Village, Nev. 89450

[21] Appl. No.: 825

[22] Filed: Jan. 6, 1987

Related U.S. Application Data

[63] Continuation-in-part of Ser. No. 815,389, Dec. 31, 1985, abandoned.

[51] Int. Cl.[4] ..... A62C 25/00

[52] U.S. Cl. ..... 169/51; 220/265; 220/266; 220/377; 312/244

[58] Field of Search ..... 169/51, 48; 312/101, 312/114, 138 R, 242, 244, 245, 248, 320; 220/265, 266, 337, 340, 341, 377; 49/463

[56] References Cited

U.S. PATENT DOCUMENTS 3,381,850 5/1968 Haugen ..... 220/337
3,394,835 7/1968 Peterson ..... 220/37
4,199,072 4/1980 Jacks ..... 220/340
4,449,588 5/1984 Benlolo et al. ..... 169/48

*Primary Examiner*—Andres Kashnikow
*Assistant Examiner*—Michael J. Forman
*Attorney, Agent, or Firm*—Shefte, Pinckney & Sawyer

[57] ABSTRACT

A cabinet structure for storing a fire extinguisher including an open front box-shaped housing and a cover mountable thereon. Mating recesses in the top wall of the housing and hinge tabs in the top side of the cover cooperate to provide pivotal engagement between the cover and housing and mating flange members on the housing and cover facilitate padlocking of the cover in mounted disposition on the housing. The hinge tabs are breakable in response to the application of a pulling force on a grip formed in the top side of the cover to facilitate emergency access to the cabinet. A peripheral lip and interior tabs on the cover facilitate proper centering of the cover on the housing.

20 Claims, 3 Drawing Sheets

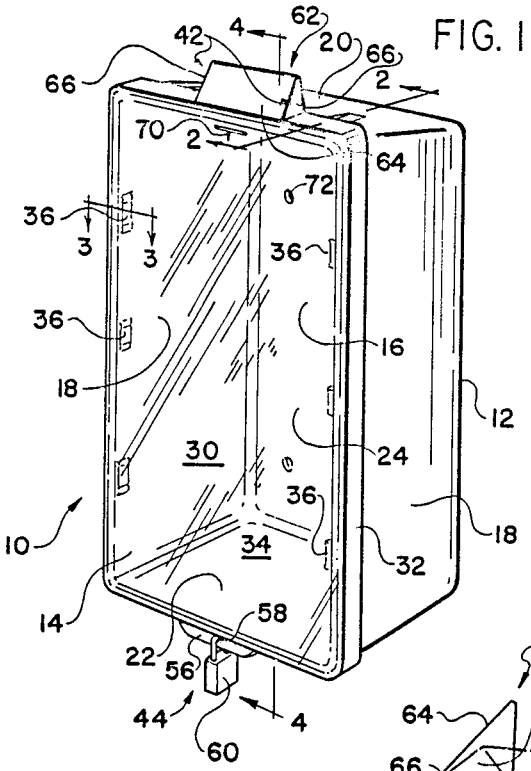
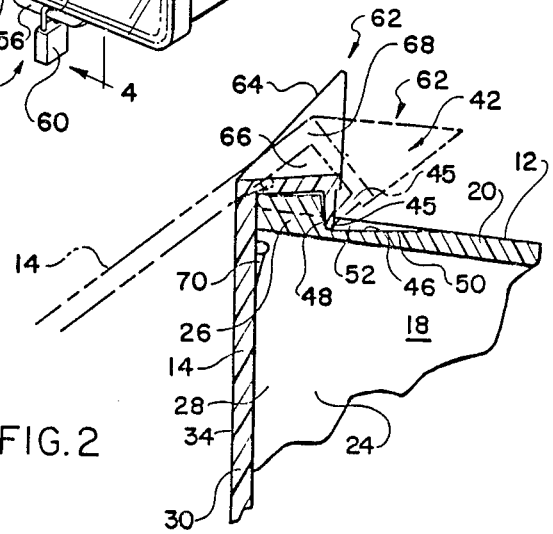
FIG. 2

CABINET STRUCTURE FOR FIRE EXTINGUISHERS OR THE LIKE

CONTINUATION-IN-PART

This is a continuation-in-part of U.S. patent application Ser. No. 815,389 filed Dec. 31, 1985, now abandoned, in the name of Thomas C. Neal entitled Cabinet Structure for Fire Extinguishers or the Like.

BACKGROUND OF THE INVENTION

The present invention relates to a cabinet structure for a fire extinguisher or other like stored article, and more particularly to the structural relationship of the cover and housing of such a cabinet.

Various conventional cabinet constructions for housing fire extinguishers are disclosed in U.S. Pat. Nos. 3,067,822; 3,220,791; 3,722,733; 4,034,697; 4,046,439; and 4,449,588. Basically, each of these conventional cabinet structures includes an open housing for receiving a fire extinguisher and a breakable door or cover lockably mounted on the housing for secure storage of the fire extinguisher while permitting emergency access thereto.

Although these conventional fire extinguisher cabinet structures are believed to function adequately for their common intended purpose, the structure that provides the attaching relationship of the cover on the housing is normally complicated and, therefore, expensive to fabricate. It is accordingly an object of the present invention to provide an improved cabinet structure for a fire extinguisher of a simplified yet reliable construction which is easy and inexpensive to fabricate.

SUMMARY OF THE INVENTION

Briefly described, the cabinet structure of the present invention includes a housing having an opening therethrough and defining a containment area accessible through the opening for receiving a fire extinguisher or similar stored article, and a cover adapted for mounting over the opening of the housing for enclosing the containment area. A mating hinge arrangement is formed on the housing at one side of the opening and on the cover at one corresponding side thereof for pivotal interengagement when the cover is mounted on the housing. The hinge arrangement is adapted to permit pivotal opening and closing movement of the cover about the one side of the housing opening toward and away from the opposite side of the housing opening and is adapted for disengagement for removal of the cover from the housing by such pivotal movement of the cover away from the opposite side of the housing opening. A securing arrangement is also formed on the housing at the opposite side of the housing opening and on the corresponding side of the cover opposite its one side. The securing arrangement is adapted for receiving a pad-lock or the like when the cover is mounted on the housing so as to cooperate with the hinge arrangement for locking the cover in mounted disposition on the housing to prevent pivotal movement of the cover away from the opposite side of the opening.

In a preferred embodiment, the housing is box-shaped with an edge bounding the opening through the housing. The cover includes a lip projecting from its outer perimeter and a plurality of centering tabs arranged about and projecting from the interior face of the cover at a spacing from the lip, the lip and centering tabs defining a plurality of channel areas therebetween adapted to receive the housing edge for centered mounting of the cover to the housing edge. The hinge arrangement includes a plurality of recesses formed in the exterior surface of the housing at spacings adjacently along one side of the housing edge and a corresponding plurality of hinge tabs projecting from the cover at spacings along its corresponding side for mated receipt in the recesses when the cover is mounted on the housing. Preferably, a positioning tab projecting from the interior face of the cover on the same side of the cover as the hinge tabs is disposed inwardly toward the housing edge for initially cooperating with the hinge tabs to position the cover on the housing. The hinge arrangement includes for each recess a retaining surface defining the side of the recess proximal the edge of the housing for engagement with the corresponding hinge tab of the cover for preventing movement of the corresponding side of the cover outwardly from the housing when the cover is mounted thereon. In this manner, the recesses and hinge tabs cooperatively permit the aforedescribed pivotal opening and closing movement of the cover about one side of the housing edge toward and away from the opposite side thereof while being adapted for disengagement for removal of the cover by such pivotal movement of the cover away from the opposite side of the housing edge. The securing arrangement includes mating flange members which respectively project outwardly from the housing and the cover at their respective sides opposite their recesses and hinge tabs. The flange members have holes formed therethrough adapted to be aligned when the cover is mounted on the housing for receiving a padlock or the like through the aligned holes. Preferably, the cover includes a substantially flat outward face with the lip projecting angularly from the outer edges thereof to facilitate easy molding formation of the cover.

A feature of the preferred embodiment is a gripping means formed on the cover proximal the hinge arrangement. Another feature has the hinge arrangement adapted to be yieldable, preferably breakable, so that the hinge tabs can be forceably disengaged from the retaining surfaces to facilitate access to the containment area in emergency situations by breakage of the hinge tabs in response to the application of a predetermined force pulling the gripping means away from the housing.

In another embodiment of the invention, the cover has a breakable central area of reduced thickness covering the housing opening to facilitate emergency access to the containment area when necessary, as an alternate to the use of the feature of the gripping means and breakable hinge tabs on the cover.

BRIEF DESCRIPTION OF THE DRAWINGS

FIG. 1 is a perspective view of a fire extinguisher cabinet structure according to the preferred embodiment of the present invention;

FIG. 2 is a vertical cross-sectional view of the hinge arrangement of the fire extinguisher cabinet structure of FIG. 1 taken along lines 2—2 thereof;

DESCRIPTION OF THE PREFERRED EMBODIMENT

Figures 3, 4:
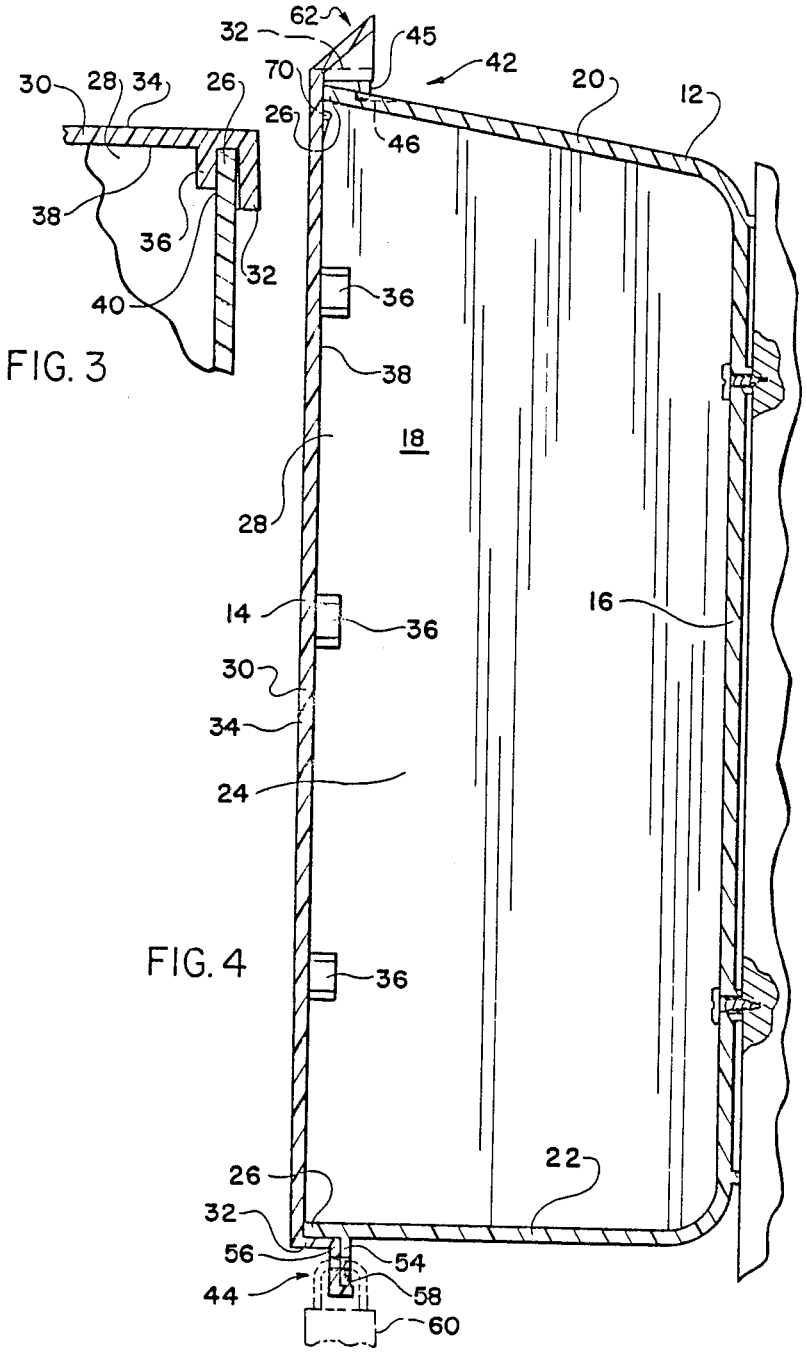
FIG. 3 is a horizontal cross-sectional view of the centering lip and tab arrangement of the cabinet structure of FIG. 1 taken along lines 3—3 thereof.
FIG. 4 is a vertical cross-sectional view of the full cabinet structure of FIG. 1 taken along lines 4—4 thereof.

Referring now to the accompanying drawings and initially to FIG. 1, the fire extinguisher cabinet structure of the present invention is indicated generally at 10 and basically includes an open front housing 12 adapted for receiving and storing a fire extinguisher and a cover 14 adapted for pivoted lockable mounting on the housing 12.

The housing 12 is essentially box-shaped having an elongated essentially rectangular flat rear wall 16, a pair of essentially flat side walls 18 extending outwardly therefrom, and top and bottom walls 20, 22, respectively, extending outwardly from the rear wall 16 transversely between the side walls 18 at their upper and lower ends to define a containment area 24 of a size adapted to receive a standard commercial fire extinguisher unit. The side, top and bottom walls 18, 20, 22 present a slightly beaded frontal edge 26 of the housing 12 bounding a frontal opening 28 through the housing 12 providing access to the containment area 24. A plurality of openings 72 are formed in the rear wall 16 of the housing 12 to facilitate mounting on a suitable vertical support surface such as a building wall or the like, the housing 12 being adapted to be either recessed within a building wall with only the frontal edge regions of the side, top and bottom walls 18, 20, 22 exposed or surface mounted on a building wall or other support surface with the rear wall 16 flush against the wall or support surface. The housing 12 is integrally molded of an appropriate high impact plastic material, preferably having flame retardant properties such as the conventional thermoplastic molding resin known as ABS.

The cover 14 includes a substantially flat main body 30 of a rectangular shape and size substantially corresponding to the frontal edge 26 of the housing 12 and has a peripheral lip 32 extending generally perpendicularly from the outer perimeter of the main body 30, whereby the cover 14 presents an essentially planar outward face 34. A plurality of centering tabs 36 are arranged about and project from the lateral sides of the interior face 38 of the main body 30 of the cover 14 at slight uniform spacings from the peripheral lip 32 to define a channel area 40 between each centering tab 36 and the adjacent portion of the peripheral lip 32 of a dimension only slightly greater than the thickness of the frontal edge 26 of the housing 12. (see FIGS. 3 and 4). The cover 14 is adapted to be mounted on the housing 12 with the peripheral lip 32 disposed outwardly about the frontal edge 26 of the housing 12 and the centering tabs 36 disposed inwardly about the frontal edge 26 to receive the frontal edge 26 within the channel areas 40 of the cover 14, whereby the peripheral lip 32 and centering tabs 36 of the cover 14 cooperatively center the cover on the frontal edge 26 of the housing 12 over the frontal opening 28 to enclose the containment area 24. The cover 14 is also integrally molded of a suitable plastic material, preferably a general purpose styrene with less shear strength than the material from which the housing 12 is molded.

A mating hinge arrangement, indicated generally at 42, in FIG. 2, is formed on the corresponding top sides of the housing 12 and cover 14 and a securing arrangement, indicated generally at 44, in FIG. 4, is formed on the opposite bottom sides of the housing 12 and cover 14, to facilitate securing the cover 14 in its mounted disposition on the frontal edge 26 of the housing 12. The hinge arrangement 42 includes a pair of recesses 46 formed in the top wall 20 of the housing 12 immediately rearwardly adjacent the frontal edge 26 of the housing 12 and a mating pair of hinge tabs 45 formed on the top side of the peripheral lip 32 of the cover 14 to matingly engage in the recesses 46 when the cover 14 is mounted on the housing 12. Each recess 46 is defined by an upright front retaining surface 48 immediately proximal the frontal edge 26 of the housing 12, a generally horizontal bottom surface 50 and a pair of upright lateral side surfaces 52 tapering rearwardly at gradually reducing vertical dimensions to merge the bottom and side surfaces 50, 52 smoothly with the top wall 20 of the housing 12. Each hinge tab 45 extends generally perpendicularly from the rearward edge of the top side of the peripheral lip 32 inwardly of the cover 14 and is of a generally rectangular shape corresponding to the front retaining surfaces 48 of the recesses 46. When the cover 14 is mounted in centered fashion on the frontal edge 26 of the housing 12 as above-described, the hinge tabs 45 are received respectively within the recesses 46 to rest against the front retaining surfaces 48 thereof. A positioning tab 70 projects from the interior face 38 of the main body 30 of the cover 14 adjacent the top thereof at a spacing for disposition inwardly of the frontal edge 26 of the housing 12 for initially cooperating with the hinge tabs 45 to position the cover 14 on the housing 12. (See FIG. 2).

As best seen in FIG. 2, the retaining surfaces 48 of the recesses 46 act on the hinge tabs 45 to prevent horizontally outward movement of the cover 14 from the housing 12 when the hinge arrangement 42 is engaged as described. The hinge tabs 45 and recesses 46 of the hinge arrangement 42, however, cooperate when so engaged to permit pivotal opening and closing movement of the cover 14 about the top side of the frontal edge 26 of the housing 12 toward and away from the opposite bottom side of the frontal edge 26 and the hinge tabs 45 and recesses 46 are adapted for disengagement to permit removal of the cover 14 from the housing 12 by such pivotal movement of the cover 14 to disengage the bottom side of the peripheral lip 32 of the cover 14 from the bottom side of the frontal edge 26 of the housing 12 followed by upward lifting movement of the cover 14 away from the bottom side of the frontal housing edge 26.

Referring to FIG. 4, the securing arrangement 44 includes a substantially flat flange member 54 projecting downwardly from the exterior surface of the bottom wall 22 of the housing 12 transversely thereacross immediately rearwardly adjacent the bottom side of the frontal edge 26 of the housing 12. A corresponding substantialy flat flange member 56 projects downwardly from the outward surface of the bottom side of the peripheral lip 32 of the cover 14 to rest immediately adjacent and parallel with the flange member 54 when the cover 14 is mounted on the housing 12 as above-described. The flange members 54, 56 have respective holes 58 formed therethrough which are adapted to be aligned in such adjacent parallel disposition of the flange members 54, 56 for receiving a conventional padlock 60 or other locking mechanism through the aligned holes 58. In this manner, when the cover 14 is mounted on the housing 12 as above-described with the hinge tabs 45 engaged within the recesses 46, the flange members 54, 56 facilitate secure locking of the cover 14 in such mounted disposition on the housing 12 to prevent pivotal opening and closing movement of the cover 14 about the top side of the frontal edge 26 of the housing 12 toward and away from the opposite bottom side of the frontal edge 26.

Figure 5:
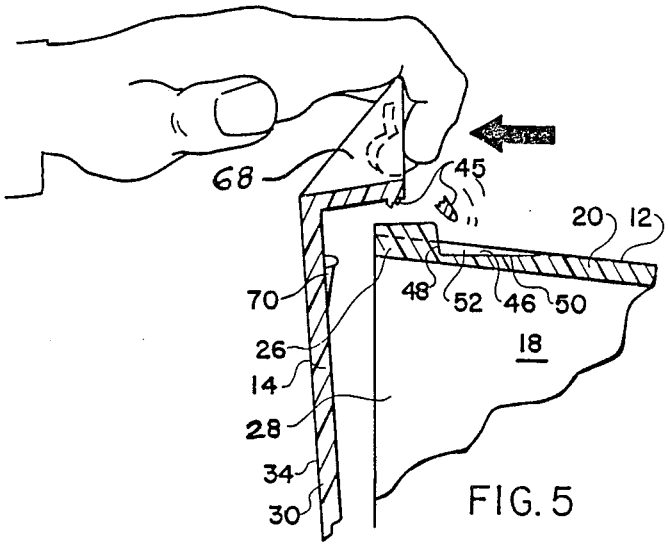
FIG. 5 is a vertical cross-sectional view of the hinge arrangement of the fire extinguisher cabinet structure of FIG. 1 taken along lines 2—2 thereof depicting disengagement of the hinge tab from the retaining surface in response to a pulling force applied to the gripping member.

According to one feature of the preferred embodiment, gripping means in the form of a gripping portion, indicated generally at 62 in FIGS. 1 and 2, is formed on the top side of the cover 14 in correspondence with the mating pair if hinge tabs 45. The gripping portion 62 includes a frontal face 64 and sides 66. The frontal face 64 slopes rearwardly and upwardly from the main body 30 of the outward face 34 of the cover 14, and the sides 66 extend generally perpendicularly from the peripheral lip 32 and the frontal face 64. When the cover 14 is mounted on the housing 12 as described above, the frontal face 64 and sides 66 of gripping portion 62 and top wall 20 of housing 12 create a recess 68 for placement of the finger tips in a gripping fashion (see FIG. 5). Additionally, when the cover 14 is mounted on the housing 12, the hinge tabs 45 resting against the retaining surfaces 48 are forceably disengageable from the retaining surfaces 48 by breakage of the hinge tabs 45, as indicated in FIG. 5, in response to a pulling force on gripping portion 62 by the finger tips outwardly from the frontal opening 28 of the housing 12 to permit emergency access to a fire extinguisher or other article stored within the containment area 24. In a further embodiment, the housing 12 and cover 14 are the same as described previously except as an alternate to the use of the feature of the gripping portion 62 and breakable hinge tabs 45 on the cover 14, the cover 14 is formed with a reduced thickness at the central area of the main body 30 to be adapted for easy breakage to permit access in an emergency situation to a fire extinguisher stored in the containment area 24.

The simplicity and economy of construction of the present fire extinguisher cabinet structure 10 will thus be recognized. Importantly, the present cabinet structure includes only two parts: the housing 12 and the cover 14 which, in conjunction with a conventional padlock 60, facilitate secure locking of the cabinet structure 10. Each of the housing 12 and cover 14, as mentioned, may be integrally molded from conventional plastic material and, because of the simple uncomplicated shapes of each component, require only simple and relatively inexpensive forming molds. For example, the cover 14 is provided with a planar outward face 34 with the peripheral lip 32 and centering tabs 36 providing a means of centered mounting of the cover 14 on the frontal edge 26 of the housing 12. In contrast with conventional fire extinguisher cabinet constructions such as the aforementioned U.S. Pat. No. 4,449,588, the cover 14 is considerably easier and less expensive to fabricate using conventional plastic molding technology. The facility of the present cabinet structure 10 for utilizing a conventional padlock 60 rather than a special locking mechanism forming part of the cabinet structure itself, as is utilized in many conventional fire extinguisher cabinet constructions, also simplifies and reduces the manufacturing cost of the present cabinet structure over conventional structures and eliminates potential problems suffered by conventional cabinet structures as a result of defective or broken locking mechanisms, lost lock keys and like problems. Additionally, access to the containment area 24 is facilitated and made safer in a preferred embodiment of the present cabinet structure with the gripping portion 62 and breakable hinge tabs 45 over conventional fire extinguisher cabinet constructions utilizing a breakable door or cover and breaker bar hung by a chain. In this preferred embodiment of the present cabinet structure the hazard of sharp points and edges resulting from breakage of the breakable door or cover is eliminated and manufacturing costs are saved by eliminating the breaker bar and chain required with conventional fire extinguisher cabinet constructions such as the aforementioned U.S. Pat. No. 4,449,588.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A cabinet structure adapted for storing a fire extinguisher or other like stored articles, said cabinet structure comprising a housing having an opening therethrough and defining a containment area accessible through said opening for receiving a stored article, a cover adapted for mounting over said opening of said housing for enclosing said containment area, mating disengagable hinge means on said housing at one side of said opening and on said cover at one corresponding side thereof for pivotal interengagement when said cover is mounted on said housing, said hinge means being adapted to permit pivotal opening and closing movement of said cover about said one side of said opening toward and away from the opposite side of said opening between a closed position wherein the side of said cover opposite its said one side is disposed in covering relation to the opposite side of said opening and an open position wherein the opposite side of said cover is spaced sufficiently from the opposite side of said opening to permit insertion and removal of a fire extinguisher or like stored article into and from said containment area without disengagement of said hinge means, said hinge means being adapted for preventing disengagement in said closed position of said cover and adapted for permitting selective disengagement for removal of said cover from said housing in said open position of said cover, said mating hinge means including a plurality of recesses formed in the exterior surface of said housing at spacings adjacently along said one side of said opening and a corresponding plurality of hinge tabs projecting from said cover at spacings along said one side thereof for mated receipt in said recesses when said cover is mounted on said housing, and securing means on said housing at said opposite side of said opening and on the corresponding side of said cover opposite said one side thereof for securing said cover in mounted disposition on said housing to prevent pivotal movement of said cover away from said opposite side of said opening.

2. A cabinet structure according to claim 1 and characterized further in that said mating hinge means includes for each said recess a retaining surface defining the side of said recess proximal said opening of said housing for engagement with the corresponding hinge tab of said cover for preventing movement of said one side of said cover outwardly from said housing when said cover is mounted on said housing.

3. A cabinet structure according to claim 1 and characterized further in that said securing means includes a flange member projecting outwardly from the exterior surface of said housing at said opposite side of said opening thereof and a flange member projecting outwardly from said cover at said opposite side thereof, said flange members having respective holes formed therethrough adapted to be aligned when said cover is mounted on said housing for receiving padlock means through said aligned holes.

4. A cabinet structure according to claim 1 and characterized further in that said cover includes lip means projecting from the outer perimeter thereof for disposition outwardly about said housing at the opening thereof for centering said cover.

5. A cabinet structure according to claim 4 and characterized further in that said cover includes a plurality of centering tabs arranged about and projecting from the interior face of said cover at a spacing from said lip means for disposition inwardly about said housing at the opening thereof for cooperating with said lip means for centering said cover.

6. A cabinet structure according to claim 4 and characterized further in that said cover includes a substantially flat outward face and said lip means projects angularly from the outer edges thereof to facilitate easy molding formation of said cover.

7. A cabinet structure according to claim 1 and characterized further in that said cover includes a breakable central area of reduced thickness covering said opening to facilitate emergency access to said containment area.

8. A cabinet structure according to claim 1 and characterized further in that said housing includes a rear wall adapted for mounting flushly against or recessed within a supporting wall structure.

9. A cabinet structure adapted for storing a fire extinguisher or other like stored articles, said cabinet structure comprising a box-shaped housing having an opening therethrough and edge means bounding said opening, said housing defining a containment area accessible through said opening for receiving and storing an article, a cover adapted for mounting to said edge means over said opening of said housing for enclosing said containment area, said cover including lip means projecting from the outer perimeter thereof and a plurality of centering tabs arranged about and projecting from the interior face of said cover at a spacing from said lip means, said lip means and said centering tabs defining a plurality of channel areas therebetween adapted to receive said edge means of said housing for centered mounting of said cover to said edge means, mating disengagable hinge means on corresponding sides of said housing and said cover for pivotal interengagement when said cover is mounted on said housing, said hinge means including a plurality of recesses formed in the exterior surface of said housing at spacings adjacently along one side of said edge means and a corresponding plurality of hinge tabs projecting from said cover at spacings along one corresponding side thereof for mated receipt in said recesses when said cover is mounted on said housing, said hinge means including for each said recess a retaining surface defining the side of said recess proximal said edge means of said housing for engagement with the corresponding hinge tab of said cover for preventing movement of said one side of said cover outwardly from said housing when said cover is mounted on said housing, said recesses and said hinge tabs being cooperatively adapted to permit pivotal opening and closing movement of said cover about said one side of said edge means toward and away from the opposite side of said edge means between a closed position wherein the side of said cover opposite its said one side is disposed in covering relation to the opposite side of said edge means and an open position wherein the opposite side of said cover is spaced sufficiently from the opposite side of said edge means to permit insertion and removal of a fire extinguisher or like stored article into and from said containment area without disengagement of said hinge means, said recesses and hinge tabs being adapted for permitting selective disengagement for removal of said cover from said housing in said open position of said cover, and securing means on said housing at said opposite side of said edge means and on the corresponding side of said cover opposite said one side thereof for securing said cover in mounted disposition on said housing to prevent pivotal opening and closing movement of said cover about said one side of said edge means toward and away from the opposite side of said edge means.

10. A cabinet structure according to claim 9 and characterized further in that said cover includes a substantially flat outward face and said lip means projects angularly from the outer edges thereof to facilitate easy molding formation of said cover.

11. A cabinet structure according to claim 9 and characterized further in that said cover includes a breakable central area of reduced thickness covering said opening to facilitate emergency access to said containment area.

12. A cabinet structure according to claim 9 and characterized further in that said securing means includes a flange member projecting outwardly from the exterior surface of said housing at said opposite side of said edge means thereof and a flange member projecting outwardly from said cover at said opposite side thereof, said flange members having respective holes formed therethrough adapted to be aligned when said cover is mounted on said housing for receiving padlock means through said aligned holes.

13. A cabinet structure adapted for storing a fire extinguisher or other like stored articles, said cabinet structure comprising a housing having an opening therethrough and defining a containment area accessible through said opening for receiving a stored article, a cover adapted for mounting over said opening of said housing for enclosing said containment area, mating hinge means on said housing at one side of said opening and on said cover at one corresponding side thereof for pivotal interengagement when said cover is mounted on said housing, gripping means on said cover proximal said mating hinge means, said hinge means being of a sufficient frangibility in response to the application of a predetermined force to said gripping means away from said opening to permit ready removal of said cover in emergency situations, said hinge means being adapted to permit pivotal opening and closing movement of said cover about said one side of said opening toward and away from the opposite side of said opening and adapted for disengagement for removal of said cover from said housing by such pivotal movement of said cover away from said opposite side of said opening, and securing means on said housing at the opposite side of said opening from said one side and on the corresponding side of said cover opposite said one side thereof, for securing said cover in mounted disposition on said housing to prevent pivotal movement of said cover away from said opposite side of said opening.

14. A cabinet structure according to claim 13 and characterized further in that said mating hinge means includes a plurality of recesses formed in the exterior surface of said housing at spacings adjacently along said one side of said opening and a corresponding plurality of hinge tabs projecting from said cover at spacings along said one side thereof for mated receipt in said recesses when said cover is mounted on said housing.

15. A cabinet structure according to claim 14 and characterized further in that said mating hinge means includes for each said recess a retaining surface defining the side of said recess proximal said opening of said housing for engagement with said corresponding hinge tab of said cover for preventing movement of said one side of said cover outwardly from said housing when said cover is mounted on said housing.

16. A cabinet structure according to claim 15 and characterized further in that said hinge tabs are forceably disengageable from said retaining surfaces by breakage of said hinge tabs in response to the application of said predetermined force to said gripping means away from said opening to permit emergency access to said containment area.

17. A cabinet structure according to claim 14 and characterized further in that said cover includes at least one positioning tab projecting from the interior face of said cover along said one side thereof at a spacing from said one side for disposition inwardly of said containment area at the opening thereof for positioning said cover on said housing.

18. A cabinet structure adapted for storing a fire extinguisher or other like stored article, said cabinet structure comprising a box-shaped housing having an opening therethrough and edge means bounding said opening, said housing defining a containment area accessible through said opening for receiving and storing an article, a cover adapted for mounting to said edge means over said opening of said housing for enclosing said containment area, said cover including lip means projecting from the outer perimeter thereof, a plurality of centering tabs arranged about and projecting from the interior face of said cover at a spacing from said lip means, said lip means and said centering tabs defining a plurality of channel areas therebetween adapted to receive said edge means of said housing for centered mounting of said cover to said edge means, mating hinge means on corresponding sides of said housing and said cover for pivotal interengagement when said cover is mounted on said housing, said hinge means including a plurality of recesses formed in the exterior surface of said housing at spacings adjacently along one side of said edge means and a corresponding plurality of hinge tabs projecting from said cover at spacings along one corresponding side thereof for mated receipt in said recesses when said cover is mounted on said housing, said hinge means including for each said recess a retaining surface defining the side of said recess proximal said edge means of said housing for engagement with the corresponding hinge tab of said cover for preventing movement of said one side of said cover outwardly from said housing when said cover is mounted on said housing, said recesses and said hinge tabs being cooperatively adapted to permit pivotal opening and closing movement of said cover about said one side of said edge means toward and away from the opposite side of said edge means and adapted for disengagement for removal of said cover from said housing by such pivotal movement of said cover away from said opposite side of said edge means, gripping means on said cover proximal said mating hinge means, said hinge means being of a sufficient frangibility in response to the application of a predetermined force to said gripping means away from said edge means to permit ready removal of said cover in emergency situations, and securing means on said housing at said opposite side of said edge means and on the corresponding side of said cover opposite said one side thereof, for securing said cover in mounted disposition on said housing to prevent pivotal opening and closing movement of said cover about said one side of said edge means toward and away from the opposite side of said edge means.

19. A cabinet structure according to claim 18 and characterized further in that said hinge tabs are forceably disengageable from said retaining surfaces by breakage of said hinge tabs in response to the application of said predetermined force to said gripping means away from said edge means to permit emergency access to said containment area.

20. A cabinet structure according to claim 18 and characterized further in that said securing means includes a flange member projecting outwardly from the exterior surface of said housing at said opposite side of said edge means thereof and a flange member projecting outwardly from said cover at said opposite side thereof, said flange members having respective holes formed therethrough adapted to be aligned when said cover is mounted on said housing for receiving padlock means through said aligned holes.

* * * * *

UNITED STATES PATENT OFFICE

CERTIFICATE OF CORRECTION

Patent No. 4,763,732 Dated August 16, 1988

Inventor(s) Thomas C. Neal

It is certified that error appears in the above-identified patent and that said Letters Patent is hereby corrected as shown below:

Col. 4, line 60 delete "substantialy" and insert — substantially —.
Col. 5, line 15 delete "if" and insert — of —.

Signed and Sealed this

Thirteenth Day of February, 199(

*Attest:*

JEFFREY M. SAMUELS

*Attesting Officer* *Acting Commissioner of Patents and Trademarks*